US010273773B2

(12) United States Patent
Collins

(10) Patent No.: US 10,273,773 B2
(45) Date of Patent: Apr. 30, 2019

(54) ELECTROMAGNETIC JARRING TOOL

(71) Applicant: Halliburton Energy Services, Inc., Houston, TX (US)

(72) Inventor: Leo G. Collins, Farmers Branch, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 223 days.

(21) Appl. No.: 15/300,734

(22) PCT Filed: May 9, 2014

(86) PCT No.: PCT/US2014/037549
§ 371 (c)(1),
(2) Date: Sep. 29, 2016

(87) PCT Pub. No.: WO2015/171161
PCT Pub. Date: Nov. 12, 2015

(65) Prior Publication Data

US 2017/0016300 A1 Jan. 19, 2017

(51) Int. Cl.
*E21B 4/06* (2006.01)
*E21B 4/12* (2006.01)
*E21B 31/107* (2006.01)

(52) U.S. Cl.
CPC ..... *E21B 31/107* (2013.01)

(58) Field of Classification Search
CPC . E21B 4/06; E21B 4/12; E21B 31/107; E21B 31/06
See application file for complete search history.

(56) References Cited

U.S. PATENT DOCUMENTS

| | | | |
|---|---|---|---|
| 2,091,680 | A | 8/1937 | Greenlee |
| 2,762,608 | A | 9/1956 | Barnes |
| 4,494,615 | A | 1/1985 | Jones |
| 4,722,402 | A | 2/1988 | Weldon |
| 4,736,797 | A | 4/1988 | Restarick, Jr. et al. |
| 4,919,219 | A | 4/1990 | Taylor |
| 6,866,096 | B2 | 3/2005 | Tillett, Jr. |
| 6,988,551 | B2 | 1/2006 | Evans |
| 7,533,724 | B2 | 5/2009 | McLaughlin |
| 8,499,836 | B2 | 8/2013 | Moriarty et al. |

(Continued)

OTHER PUBLICATIONS

International Search Report and Written Opinion of PCT Application No. PCT/US2014/037549 dated Feb. 4, 2015: pp. 1-14.

*Primary Examiner* — Catherine Loikith
(74) *Attorney, Agent, or Firm* — Chamberlain Hrdlicka

(57) ABSTRACT

An electromagnetic jarring tool and related systems and methods provide for the use of an electromagnetic system to generate jarring forces within a wellbore. The electromagnetic jarring tool includes a chamber having a first end and a second end, a magnetic hammer disposed within the chamber, and an electromagnet operable to generate an electromagnetic field across at least a portion of the chamber. The magnetic hammer is operable to move toward the second end of the chamber in response to the electromagnetic field to deliver an impact. One or more electromagnets may be included to enhance operation of the tool, and the tool may be actuated by a surface controller that selectively delivers electrical power or a control signal to the tool to specify a mode of operation of the electromagnetic jarring tool.

19 Claims, 7 Drawing Sheets

(56) References Cited

U.S. PATENT DOCUMENTS

| | | | | |
|---|---|---|---|---|
| 2004/0108108 | A1* | 6/2004 | Bailey | E21B 7/06<br>166/242.6 |
| 2009/0095490 | A1 | 4/2009 | Moriarty et al. | |
| 2012/0285686 | A1 | 11/2012 | Xu | |

* cited by examiner

ELECTROMAGNETIC JARRING TOOL

FIELD OF THE INVENTION

The present disclosure relates generally to jarring tools for use in moving downhole tools within a wellbore.

DESCRIPTION OF RELATED ART

Wells are drilled at various depths to access and produce oil, gas, minerals, and other naturally-occurring deposits from subterranean geological formations. The drilling of a well is typically accomplished with a drill bit that is rotated within the well to advance the well by removing topsoil, sand, clay, limestone, calcites, dolomites, or other materials to form a wellbore. The drill bit is typically attached to a drill string that may be rotated to drive the drill bit and within which drilling fluid, referred to as "drilling mud" or "mud", may be delivered downhole. The drilling mud is used to cool and lubricate the drill bit and downhole equipment and is also used to transport any rock fragments or other cuttings to the surface of the well.

After the wellbore is formed, tools may be deployed by, for example, wireline, slickline, or other conveyances. Wireline-delivered tools are suspended from a wireline that is electrically connected to control systems at the surface of the well, usually for the purposes gathering and conveying data about the formation, wellbore, or fluid in the wellbore. Slickline tools are similarly deployed into a wellbore but may not have an electrical connection to surface equipment. The tools may be deployed by first removing the drill string and then lowering the wireline and tools to an area of interest within the formation. The tools associated with wireline and slickline deployment may be used to measure pressure, temperature, and other properties of formation and wellbore fluids, and may require electric power to operate.

BRIEF DESCRIPTION OF THE DRAWINGS

Illustrative embodiments of the present invention are described in detail below with reference to the attached drawing figures, which are incorporated by reference herein and wherein.

Figure 1A:
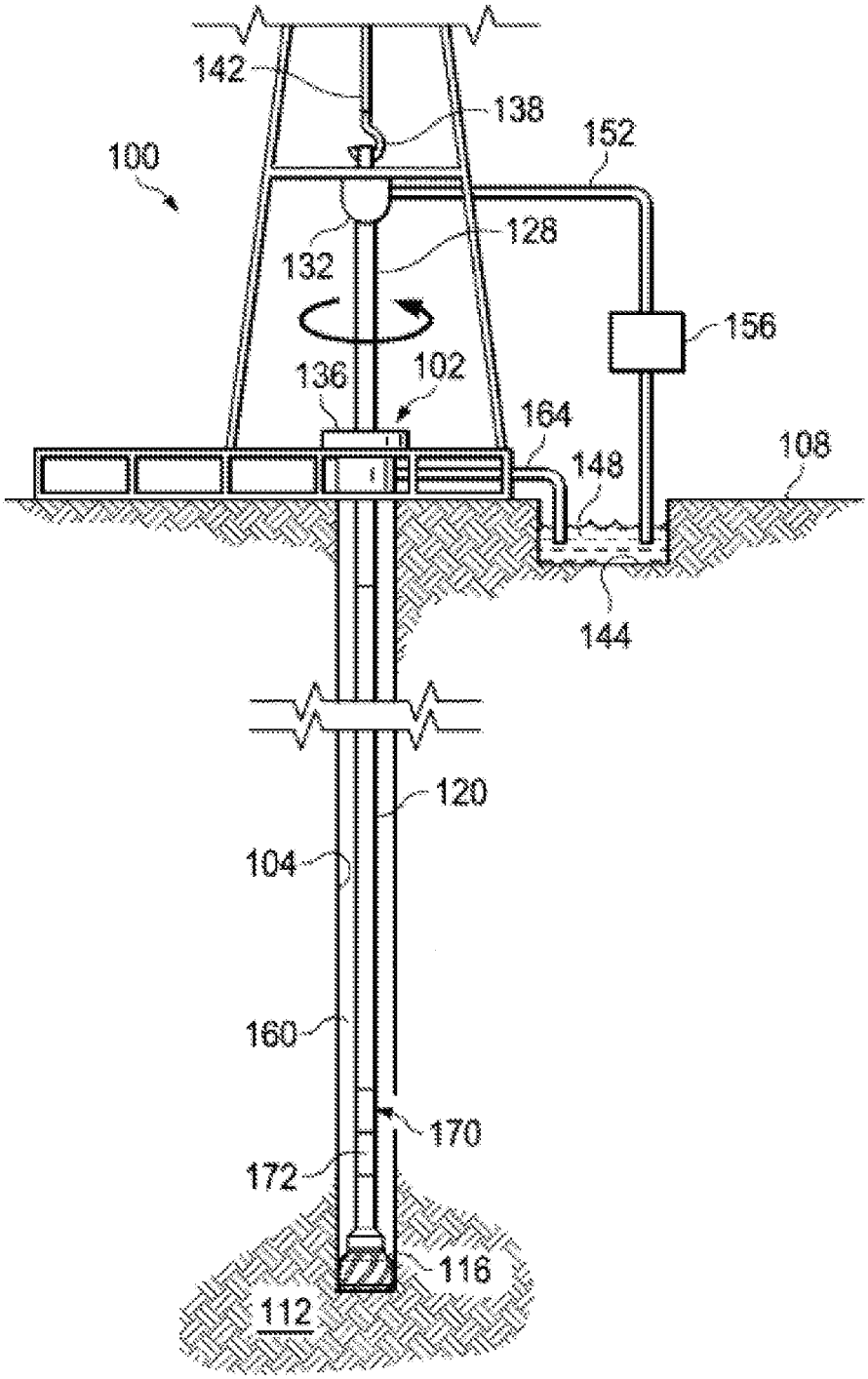
FIG. 1A illustrates a schematic view of a well in which an illustrative embodiment of an electromagnetic jarring tool is deployed.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

In addition to the types of downhole tools mentioned above, other downhole operations may also necessitate the use of downhole electrically powered systems and devices. Yet in some situations, it may be difficult, costly, or impractical to supply a dedicated power line or battery to such systems and devices. As a result, downhole tools may include mechanisms for generating power downhole. Such power generation mechanisms may include turbines that harvest kinetic energy from the fluid circulating through the wellbore, circuits that derive energy from steady-state tool vibrations, or similar systems derived from energy sources that operate at a steady state.

When tools used in drilling operations or in subsequent wireline and slickline operations become stuck, it may be necessary to deliver an impact to the stuck tool to free the tool and allow it to be repositioned or removed from a wellbore. Drilling, testing, and production equipment, for example, may become stuck in the wellbore and freed upon the application of sufficient impact delivered along the axis of the tool string. Such an impact may be referred to herein as an axial impact.

To deliver such an axial impact, a jar may be deployed within the tool string. For example, a "drilling jar" may be included in a drill string or a production string to free drilling or production equipment that becomes stuck in the wellbore. In operation, such a jar may be placed or installed in the tool string near the location of the stuck equipment and actuated to deliver an axial impact or series of axial impacts to dislodge the stuck equipment. Once the equipment is dislodged, drilling operations or production operations may continue.

Other types of jars may be inserted into a wellbore to retrieve a tool that has become lodged in a wellbore. Such jars may be referred to as "fishing jars", and may include an attachment that couples the jar to the tool so that the jar may be actuated to deliver an impact to the tool to dislodge the tool from the wellbore. Similar jars may be included in slickline and wireline tool strings adjacent tool modules to free stuck tooling or to dislodge the tool string if it becomes stuck.

A typical jar may include a movable hammer and mandrel assembly that is enclosed but movable within a stationary housing. The housing may include a surface that is configured to absorb impact from the hammer, which may be referred to as an anvil. The jar may be actuated to cause the hammer to accelerate into the anvil, resulting an in impact and resultant force that is imparted to the housing body and adjacent tooling elements.

Typical jars include hydraulic jars, mechanical jars, mechanical-hydraulic jars, and bumper jars. Hydraulic jars and mechanical jars are typically configured to deliver an upward or downward force relative to the tool string, while bumper jars are typically configured to deliver a downward force. A typical bumper jar may be actuated by lifting and dropping a pipe, which in turn causes the hammer of the jar to strike the anvil to deliver an impact that results in a downward force. Conversely, mechanical, hydraulic, and mechanical-hydraulic jars typically include actuation mechanisms that activate in response to the application of a control signal, which may be a pressure pulse or an application of tensile strain to a cable or tool string from which the jar is deployed. The cable or tool string may be referred to herein as a conveyance. In operation of a mechanical, hydraulic, or mechanical-hydraulic jar to deliver an upward force, a tensile load is applied to the conveyance. The tensile load results in the storage of potential energy in the jar until the load exceeds a threshold magnitude, which results in actuation of the jar. Such jars may also be used to provide an upward impact by reversing the orientation of the jar and applying a compressive load to the conveyance.

The jars discussed above typically perform well in normal operating environments, but may not be well suited to deliver multiple impacts in heavy fluid, high pressure, or in deviated wells. Such wells may include segments of wellbore that vary from vertical to horizontal or near-horizontal. The present disclosure relates to an electromagnetic jarring tool that performs well in such environments and includes a triggering mechanism that is not materially affected by gravitational forces.

The electromagnetic jarring tool may include a chamber having a first end and a second end and a magnetic hammer disposed within the chamber. The chamber may be a vacuum chamber, an atmospheric chamber, or prefilled with a gas that does not interfere with the movement of the magnetic hammer. The electromagnetic jarring tool may also include an electromagnet, which may be a conductive coil that is operable to receive a current and generate an electromagnetic field across at least a portion of the chamber. Further, it is noted that while a conductive coil is described as an illustrative apparatus for generating an electromagnetic force to cause movement of the magnetic hammer, other types of electromagnets may be used. For example, a discrete electromagnet may be assembled at either end of the chamber described below to attract or repulse the electromagnetic hammer to generate jarring forces when the magnetic hammer strikes anvils within the hammer.

The magnetic hammer is operable to move toward the second end of the chamber in response to the electromagnetic field to deliver an impact. As such, the chamber and magnetic hammer may be formed to have complementary dimensions so that the magnetic hammer and chamber resemble a piston and cylinder, respectively, to allow for movement of the magnetic hammer from one end of the chamber to the other. In addition, the magnetic hammer and chamber may be formed with complementary alignment features to ensure that the magnetic hammer moves through the chamber along the axis of the chamber. Such alignment features may include, for example, one or more projections and complementary grooves that slidably engage one another to allow constrained movement of the magnetic hammer within the chamber. The grooves and protrusions may be formed on the interior surface of the chamber and exterior surface of the magnetic hammer, respectively. In another embodiment, the grooves and protrusions may be formed on the exterior surface of the magnetic hammer and interior surface of the chamber, respectively. In an embodiment, a low-friction interface may be provided between the magnetic hammer and the cylinder. Such a low-friction interface may be a lubricant, a low-friction layer applied to one or both of the magnetic hammer and chamber, a low-friction coating applied to one or both of the magnetic hammer and chamber, or any combination of the foregoing.

Figure 1B:
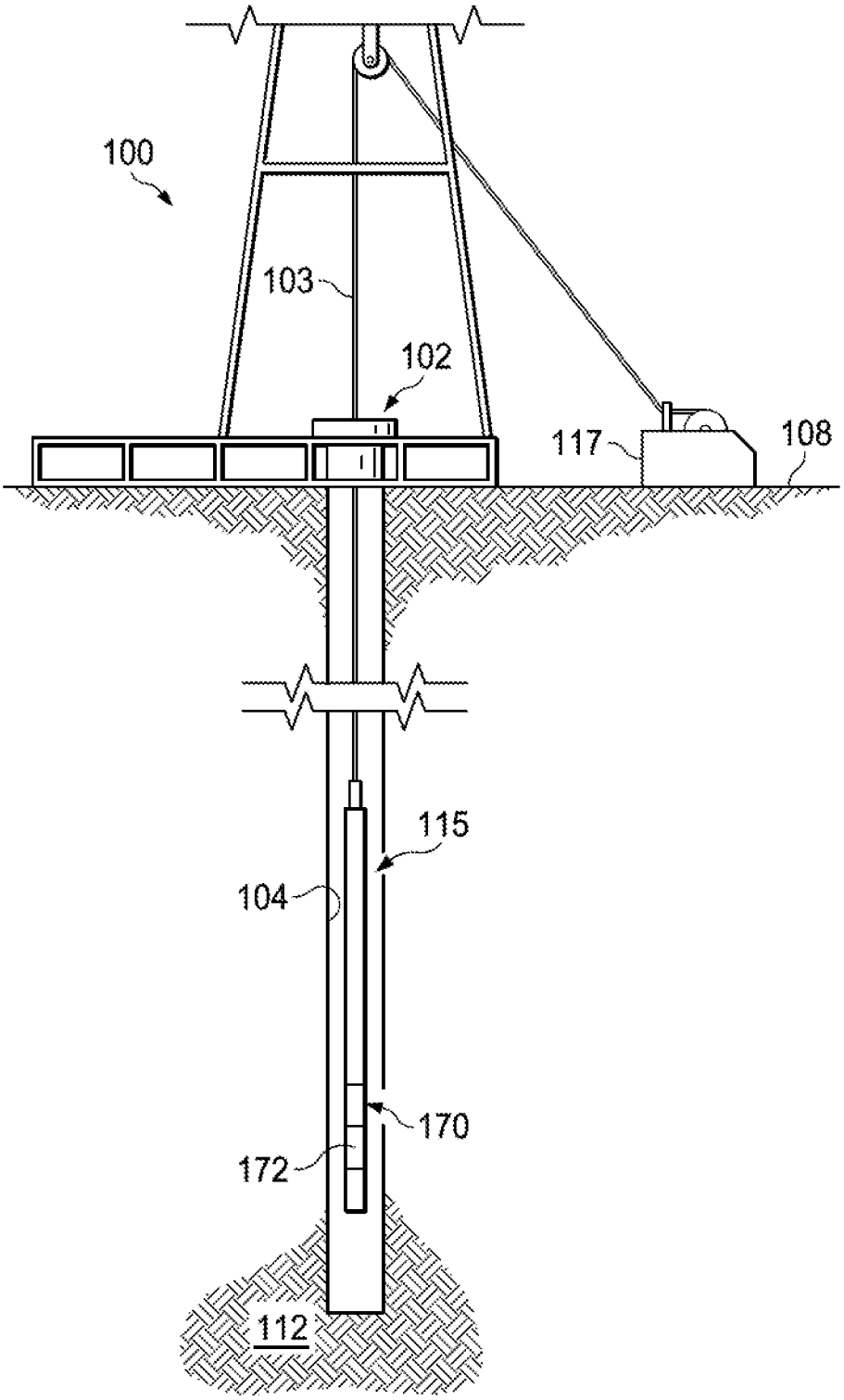
FIG. 1B illustrates a schematic view of a well in which the electromagnetic jarring tool of FIG. 1A is deployed in a wireline assembly.
Figure 1C:
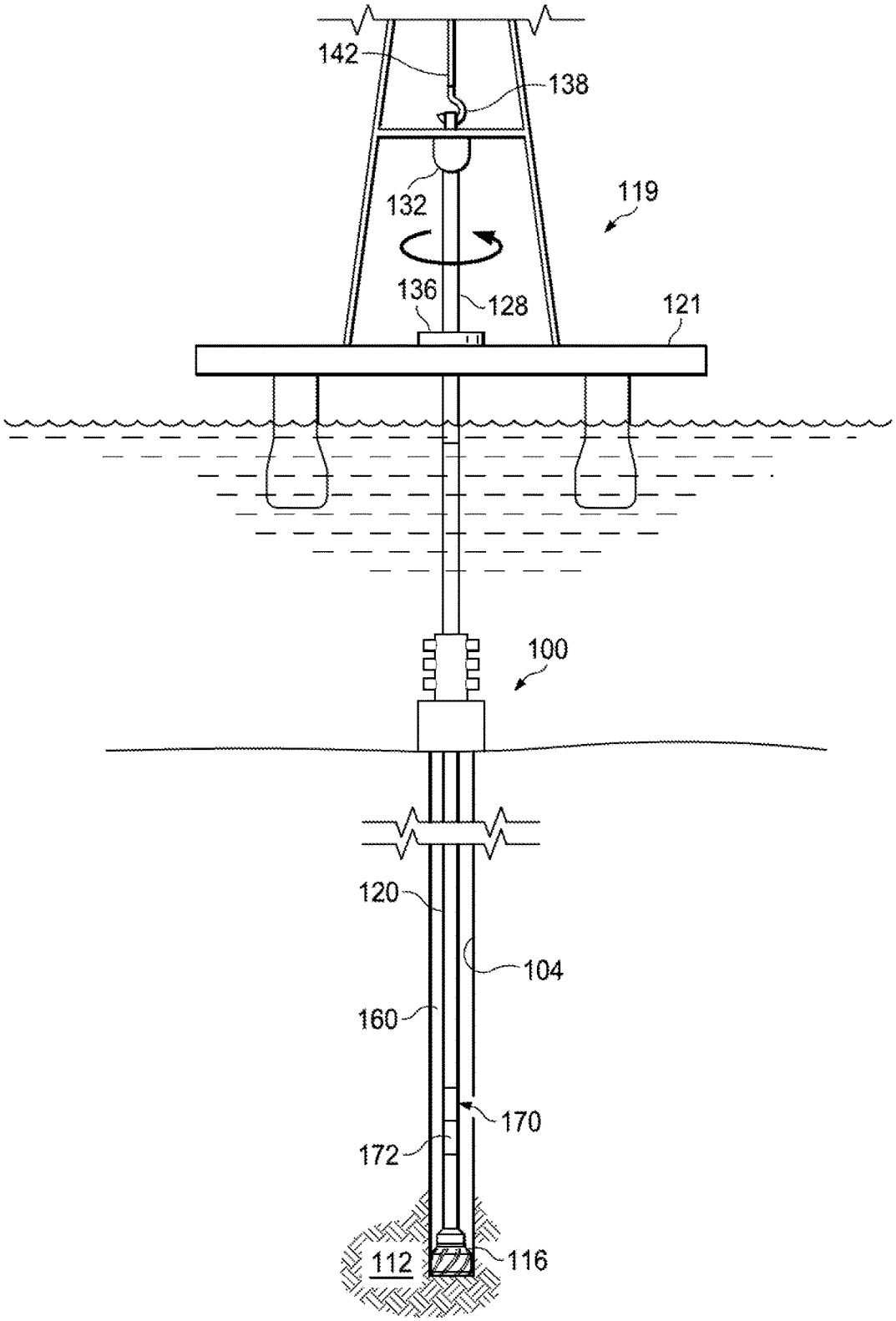
FIG. 1C illustrates a schematic view of a subsea well in which the electromagnetic jarring tool of FIG. 1A is deployed.

Referring now to the Figures, FIGS. 1A-1C show an illustrative embodiment of a downhole system 100 that includes an electromagnetic jarring tool 170. The downhole system 100 is used in a well 102 having a wellbore 104 that extends from a surface 108 of the well to or through a subterranean geological formation 112. The well 102 is illustrated onshore in FIG. 1A with the system 100 being deployed in a land-based well. Alternatively, the system 100 may be deployed as part of a wireline assembly 115 (see FIG. 1B), either onshore or off-shore. The wireline assembly 115 includes a winch 117 to lift and lower a downhole portion of the wireline assembly 115 into the well. In still another embodiment, the system 100 may be deployed in a subsea well 119 (see FIG. 1C) accessed by a fixed or floating platform 121. FIGS. 1A-1C each illustrate these possible uses of the system 100, and while the following description of the system 100 and associated energy harvesting subsystems focuses primarily on the use of the system 100 in the drill string 120 of FIG. 1A, the system 100 may be used instead in the well configurations illustrated in FIGS. 1B and 1C, as well as in other well configurations where it is desired to harvest energy downhole. Similar components in FIGS. 1A-1C are identified with similar reference numerals.

In the embodiment illustrated in FIG. 1A, the well 102 is formed by a drilling process in which a drill bit 116 is turned by a drill string 120 that extends the drill bit 116 from the surface 108 to the bottom of the well 102. The drill string 120 may be made up of one or more connected tubes or pipes of varying or similar cross-section. The drill string may refer to the collection of pipes or tubes as a single component, or alternatively to the individual pipes or tubes that comprise the string. The term drill string is not meant to be limiting in nature and may refer to any component or components that are capable of transferring energy from the surface of the well to the drill bit. In several embodiments, the drill string 120 may include a central passage disposed longitudinally in the drill string and capable of allowing fluid communication between the surface of the well and downhole locations.

At or near the surface 108 of the well, the drill string 120 may include or be coupled to a kelly 128. The kelly 128 may have a square, hexagonal or octagonal cross-section. The kelly 128 is connected at one end to the remainder of the drill string and at an opposite end to a rotary swivel 132. The kelly passes through a rotary table 136 that is capable of rotating the kelly and thus the remainder of the drill string 120 and drill bit 116. The rotary swivel 132 allows the kelly 128 to rotate without rotational motion being imparted to the rotary swivel 132. A hook 138, cable 142, traveling block (not shown), and hoist (not shown) are provided to lift or lower the drill bit 116, drill string 120, kelly 128 and rotary swivel 132. The kelly 128 and swivel 132 may be raised or lowered as needed to add additional sections of tubing to the drill string 120 as the drill bit 116 advances, or to remove sections of tubing from the drill string 120 if removal of the drill string 120 and drill bit 116 from the well 102 is desired.

A reservoir 144 is positioned at the surface 108 and holds drilling mud 148 for delivery to the well 102 during drilling operations. A supply line 152 is fluidly coupled between the reservoir 144 and the inner passage of the drill string 120. A pump 156 drives fluid through the supply line 152 and downhole to lubricate the drill bit 116 during drilling and to carry cuttings from the drilling process back to the surface 108. After traveling downhole, the drilling mud 148 returns to the surface 108 by way of an annulus 160 formed between the drill string 120 and the wellbore 104. At the surface 108, the drilling mud 148 is returned to the reservoir 144 through a return line 164. The drilling mud 148 may be filtered or otherwise processed prior to recirculation through the well 102.

The electromagnetic jarring tool 170 may be positioned downhole adjacent a downhole tool 172 or work piece to prevent the tool 172 or work piece from becoming lodged in the wellbore 104 or to dislodge the tool 172 in the event the tool 172 becomes stuck. Electromagnetic jarring tool 170 may include threaded connections or similar connections at each end to allow for insertion into a tool string or coupling to a discrete tool.

The tool 172 may be any number of downhole tools. For example, the tool 172 may be a measurement device that measures temperature, pressure, acceleration, or forces that are experienced by the tool 172. While the electromagnetic jarring tool 170 and tool 172 are illustrated as a part of the drill string 120 in FIG. 1A, in other embodiments, the electromagnetic jarring tool 170 may be lowered into the well by wireline 103 (see FIG. 1B), slickline, or any other suitable conveyance, either through the central passage of the drill string 120, or if the drill string 120 is not present, directly through the wellbore 104. As described in more detail below, the electromagnetic jarring tool 170 and tool 172 may include a communications subsystem, including a transceiver for communicating using mud pulse telemetry or another suitable method of wired or wireless communication with a surface controller. The transceiver may transmit data gathered by the tool 172 or receive instructions from a well operator via the surface controller to operate the tool 172 or electromagnetic jarring tool 170.

The electromagnetic jarring tool 170 is an electromagnetically-actuated apparatus that delivers an impact load to another object within a drill string 120, completion string, or other tool string deployed in the wellbore 104. The electromagnetic jarring tool 170 may be used to free a stuck object or to set the tool 172. Generally, the electromagnetic jarring tool 170 includes a movable element, which may be a magnetic hammer that is activated to generate an impact on a stationary member. The stationary member may be an anvil or impact surface at either end of a chamber or housing that encloses the movable element. The electromagnetic jarring tool 170 may be actuated by activating an electromagnetic field that results in the application of an electromagnetic force against the magnetic hammer to generate an impact when the magnetic hammer collides with the stationary member. The electromagnetic jarring tool 170 can be actuated multiple times as needed and generate an impact in either direction along the tool string, regardless of the orientation of the wellbore.

Figure 2A:
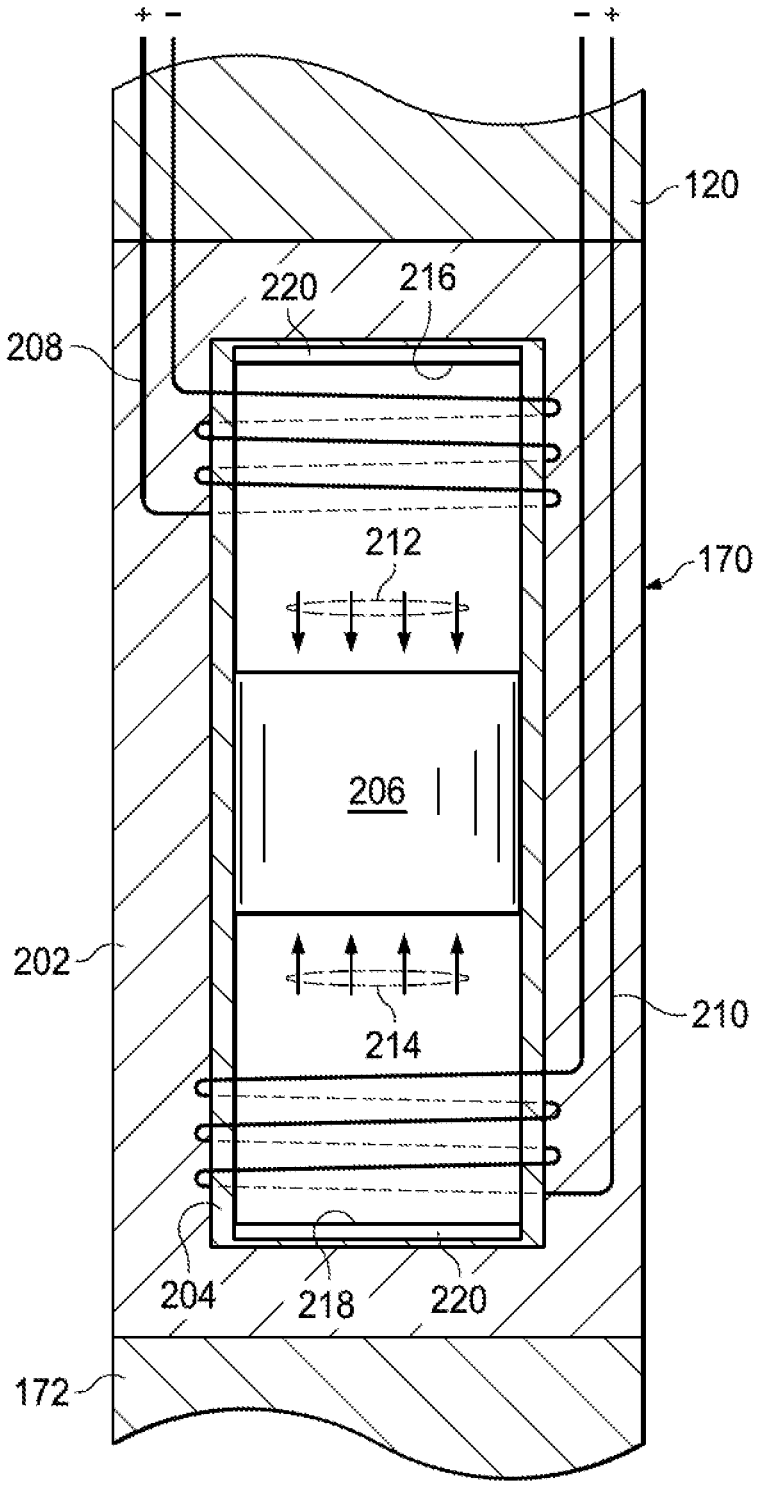
FIG. 2A is a sectional view of an embodiment of the electromagnetic jarring tool of FIG. 1A, in which a magnetic hammer of the jarring tool is in a centered location.
Figure 2B:
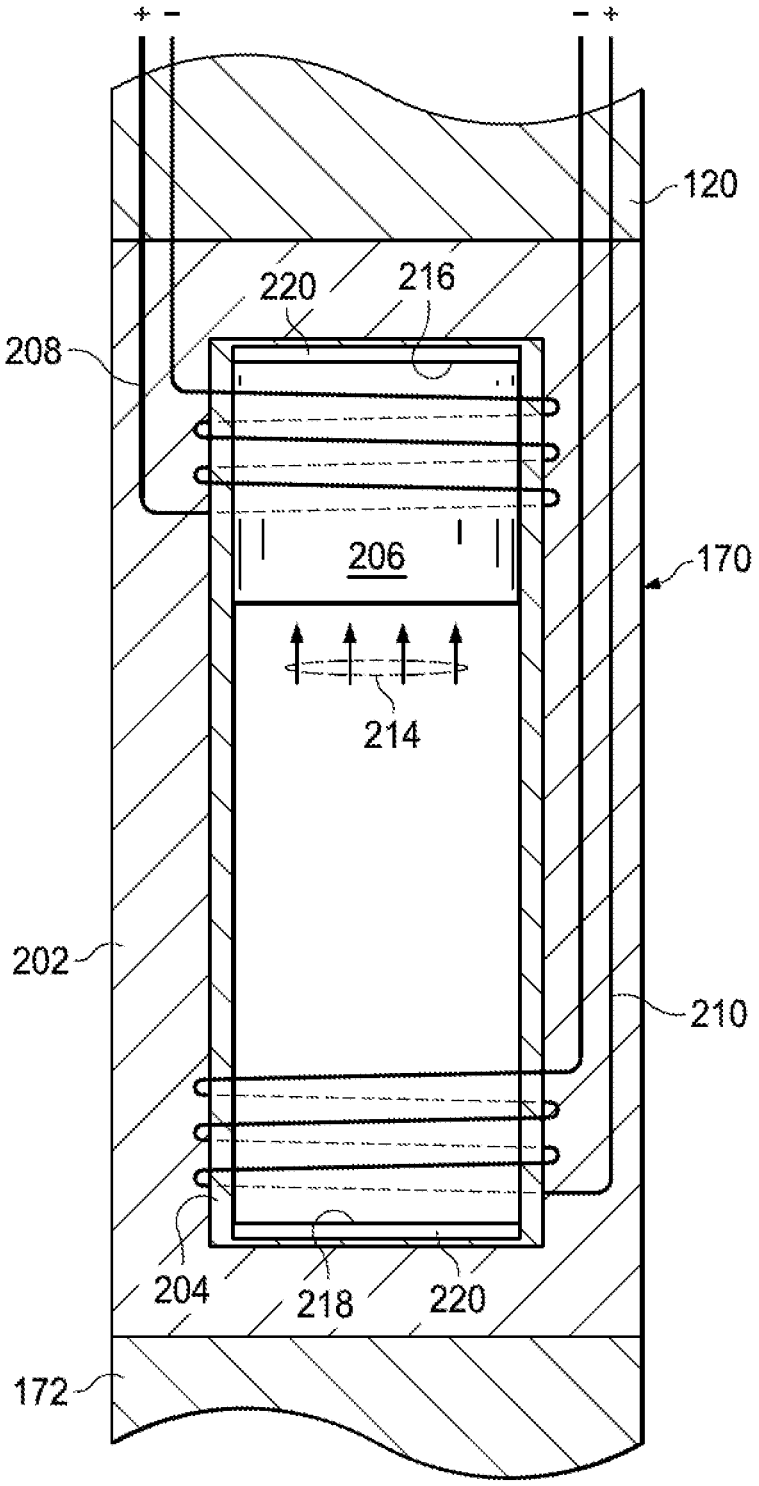
FIG. 2B is a sectional view of an embodiment of the electromagnetic jarring tool of FIG. 2A, in which a magnetic hammer of the jarring tool is actuated to deliver an upward impact.
Figure 2C:
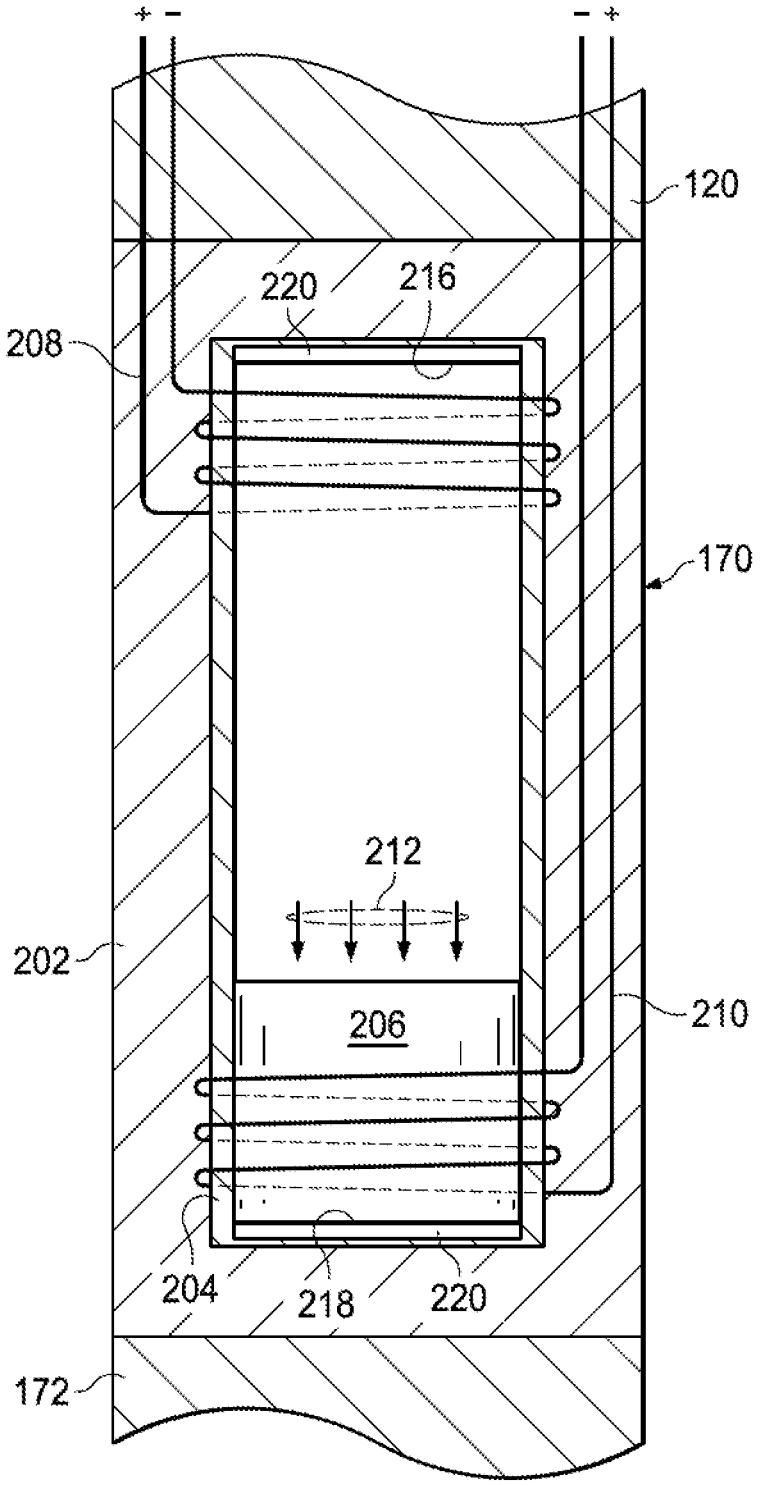
FIG. 2C is a sectional view of an embodiment of the electromagnetic jarring tool of FIG. 2A, in which a magnetic hammer of the jarring tool is actuated to deliver a downward impact.

FIGS. 2A-2C show an illustrative embodiment of an electromagnetic jarring tool 170 as it transitions from a pre-actuated state FIG. 2A, to a first actuated state in FIG. 2B, and a second actuated state in FIG. 2C. to generate jarring forces toward either end of the electromagnetic jarring tool 170. The electromagnetic jarring tool 170 may be deployed in the wellbore by a conveyance, which may be a drill string, wireline, slickline, or other conveyance. The electromagnetic jarring tool 170 includes a housing 202, which may be a generally cylindrical housing included within a tool string. Within the housing, the electromagnetic jarring tool 170 includes a chamber 204 having a first end 216 and a second end 218. Each of the first end 216 and second end 218 may include an anvil 220 to absorb and transfer impacts that generate jarring forces to the tool string 120 and an adjacent tool 172.

The aforementioned impacts are generated by collisions between the anvils 220 and a magnetic hammer 206. The magnetic hammer 206 may be formed from a permanent magnet, an electromagnetic, a magnetized material, a ferromagnetic material, or any combination of the foregoing that renders the magnetic hammer 206 susceptible to an electromagnetic force.

In an embodiment, the magnetic hammer 206 is enclosed within the chamber 204, and operable to slide between the first end 216 and the second end 218. To minimize resistance or fluid effects on the movement of the magnetic hammer 206, the chamber 204 may be an atmospheric chamber, a vacuum chamber, or another chamber prefilled with a low-density fluid that does not significantly resist movement of the magnetic hammer 206. In an embodiment, the configuration of the chamber 204 allows the magnetic hammer 206 to move freely in either direction within the chamber 204 without contact with well fluids.

To actuate the magnetic hammer 204, the electromagnetic jarring tool 170 includes at least a first conductive coil 208 that is wrapped around at least a portion of the chamber 204. In an embodiment, the first conductive coil 208 is wrapped around the chamber 204 from approximately the first end 216 to the second end 218. The first conductive coil 208 is operable to receive a current that flows through the first conductive coil 208 and around the chamber 204 to generate a magnetic field 212 within the chamber 204 to impart an electromagnetic force on the magnetic hammer 206. The direction of current flow through the first conductive coil 208 and resultant magnetic field 212 generates an upward or downward electromagnetic force on the magnetic hammer 206, depending on the polarity of the magnetic hammer 206. For example, where the magnetic field 212 has a positive polarity facing downward, and a top surface of the magnetic hammer 206 is positively polarized, the electromagnetic force propels the magnetic hammer 206 downward to impact the second end 218 of the chamber 204. Conversely, where the magnetic field 212 has a negative polarity facing downward, and the top surface of the magnetic hammer 206 is positively polarized, the electromagnetic force propels the magnetic hammer 206 upward to impact the first end 216 of the chamber 204, as shown in FIG. 2B.

In an embodiment, the electromagnetic jarring tool 170 also includes a second conductive coil 210, which may be configured to operate in unison with the first conductive coil 208, or to generate a second magnetic field 214 that opposes the first magnetic field 212. In such an embodiment, current may be alternatingly provided to the first conductive coil 208 and second conductive coil 210 to effectuate magnetic fields 212, 214 that selectively motivate the magnetic hammer 206 toward the first end 216 or second end 218 of the chamber 204.

In operation, the electromagnetic jarring tool 170 may be actuated without any mechanical manipulation of the wireline from the surface, and the electromagnetic jarring tool 170 may be actuated within a tool string while tension remains applied to the tool string to provide additional force to free a stuck object. The actuation of the magnetic hammer 206 is controllable by the application of electric current from the surface, or from the application of electric current from a local power source in response to a control signal received from the surface. The current may be selectively applied to one or more conductive coils to cause the magnetic hammer to move in either direction. In addition, the current may be varied in magnitude to controllably select the magnitude of the impact, or impacts, delivered by the electromagnetic jarring tool 170. In general, higher current may be understood to result in severe impacts and greater impact forces applied to adjacent tools or the tool string that includes the electromagnetic jarring tool 170. In addition, the electromagnetic jarring tool 170 may vary in the length of travel and mass of the magnetic hammer 206 to allow for the achievement of relatively heavy jarring. Similarly, the current may be supplied at a low rate for relatively light or delicate jarring.

In an embodiment, the electromagnetic jarring tool 170 may be configured such that the magnetic hammer 206 is self-centering. Self-centering may be achieved by including an additional, relatively low-power conductive coil or electromagnet that causes the magnetic hammer to return to a pre-actuated position, which may be at the center of the chamber 204 or at an end of the chamber that is opposite the anvil that is intended to be impacted in the case of unidirectional jarring. In another embodiment, multiple conductive coils may be used to apply equivalent electromagnetic forces to each side of the magnetic hammer 206 until the magnetic hammer 206 comes to rest at the center of the chamber 204. In addition, the electromagnetic jarring tool 170 may be reinitialized by alternatively applying small amounts of current to generate an electromagnetic force to urge the magnetic hammer 206 away from the end of the chamber 204 at which impact is desired, or by continuously supplying current to a low-powered electromagnet that causes the magnetic hammer 206 to return to its pre-actuated position.

Figure 3:
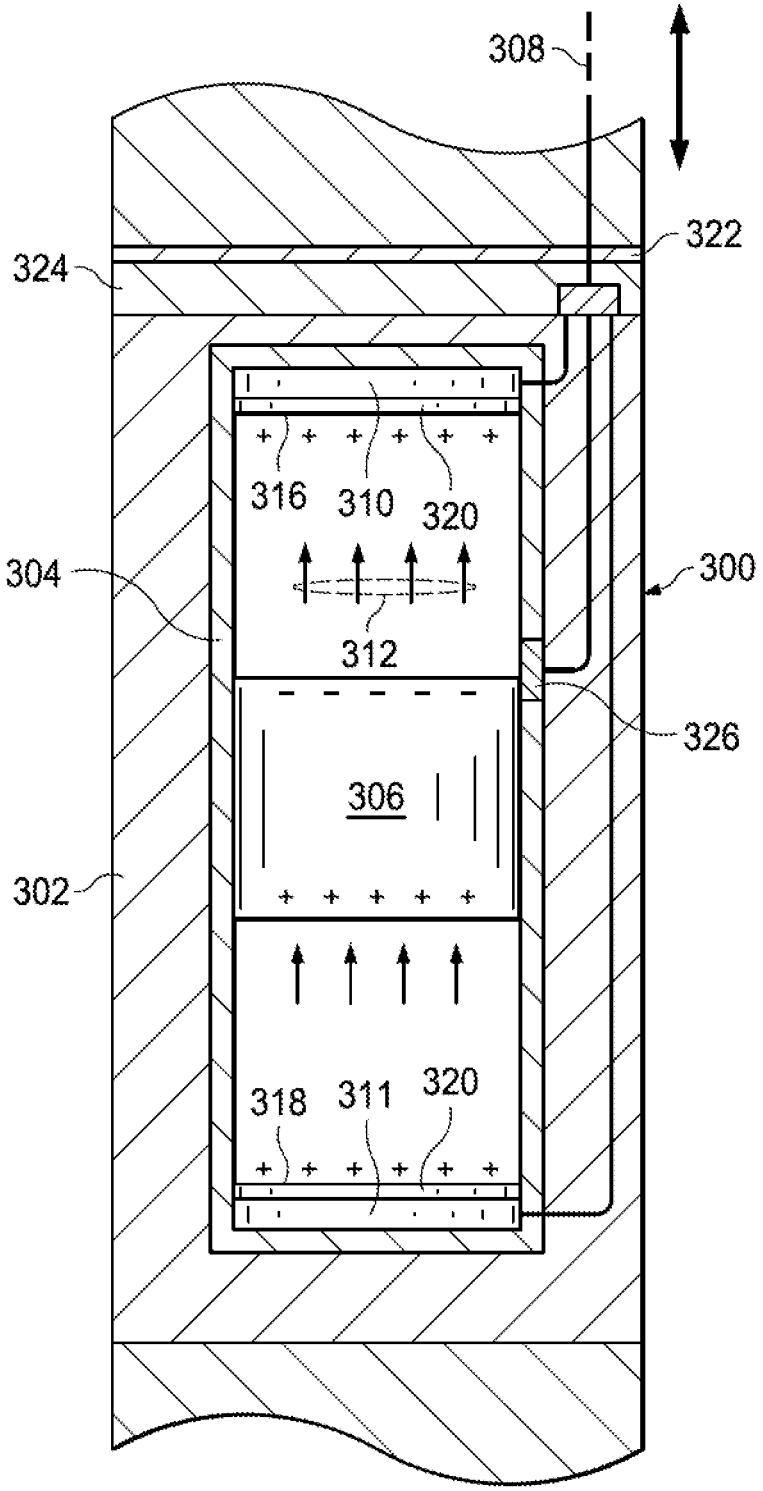
FIG. 3 is a sectional view of an alternative embodiment of the electromagnetic jarring tool having discrete electromagnets.

FIG. 3 shows an alternative embodiment of an electromagnetic jarring tool 300 that is similar in many respects to the electromagnetic jarring tool 170 described above with regard to FIGS. 2A-2C. The electromagnetic jarring tool 300 includes a housing 302, which may be a generally cylindrical housing included within a tool string. In an embodiment, the housing 302 may be formed to have the shape of an annulus so that it can be deployed as a segment of a drill string that allows fluids to flow through a conduit formed by the housing 302. In another embodiment, the housing 302 may have any other shape or profile, such a cylindrical profile or a rectangular profile and be sized to have a cross section that is smaller than the cross section of a drill string so that the electromagnetic jarring tool may be deployed within a drill string.

Within the housing 302, the electromagnetic jarring tool 300 includes a chamber 304 having a first end 316 and a second end 318. Each of the first end 316 and second end 318 may include an anvil 320 to absorb impacts that impart jarring forces to the tool string and adjacent tools or other objects when the magnetic hammer 306 collides with the anvils 320. Again, the magnetic hammer 306 may be formed from a permanent magnet, an electromagnet, a magnetized material, a ferromagnetic material, or any combination of the foregoing that renders the magnetic hammer 306 susceptible to an electromagnetic force. The magnetic hammer 306 is enclosed within the chamber 304, and operable to slide between the first end 316 and the second end 318. The chamber 304 may be an atmospheric chamber, a vacuum chamber, or another chamber prefilled with a low-density fluid that does not significantly resist movement of the magnetic hammer 306.

To actuate the magnetic hammer 306, the electromagnetic jarring tool 300 includes a first electromagnet 310 installed adjacent the first end 316 of the chamber 304 and a second electromagnet 311 installed adjacent the second end 318 of the chamber 304. In another embodiment, a single electromagnet may be used in place of the first electromagnet 310 and second electromagnet 311. The first electromagnet 310 and second electromagnet 311 are operable to apply an electromagnetic force, as indicated by the arrow 312 to move the magnetic hammer 306 from one end of the chamber 304 to the other.

The magnitude and direction of the electromagnetic force may be controlled by a controller 324 that is coupled to a power source 322 to supply power to the electromagnets. In turn, the controller 324 is communicatively coupled to a surface controller via a control line 308. The surface controller may generate a control signal to the controller 324 to specify a mode of operation of the electromagnetic jarring tool 300, as described in more detail below. In another embodiment, the controller 324 and power source 322 may be omitted and the surface controller may be directly coupled to the electromagnets to supply power from a remote power source to operate the electromagnets. Like the electromagnetic jarring tool 170 described above with regard to FIGS. 2A-2C, the first electromagnet 310 and second electromagnet 311 may generate an upward or downward electromagnetic force on the magnetic hammer 306, depending on the polarity of the magnetic hammer 306. Depending on the specified mode of operation, the first electromagnet 310 and second electromagnet 311 may be operated to controllably cause the magnetic hammer to collide with the anvils 320 to generate the desired jarring forces. To cause the magnetic hammer 306 to self-center or return to a pre-actuated position within the chamber 304, a third electromagnet or a permanent magnet 326 that generates a relatively weak magnetic field (relative to the electromagnets) may be included near the center of the chamber or at a location that corresponds with the pre-actuated position of the magnetic hammer 306 to facilitate repeated activation of the electromagnetic jarring tool 300.

In accordance with the foregoing disclosure, an electromagnetic jarring tool is disclosed that includes a chamber having a first end and a second end and a magnetic hammer disposed within the chamber. The electromagnetic jarring tool also includes at least one conductive coil operable to receive a current and generate an electromagnetic field across at least a portion of the chamber. In an embodiment, the magnetic hammer is operable to move toward the second end of the chamber in response to the electromagnetic field to deliver an impact when the magnetic hammer strikes an anvil at the second end of the chamber. The electromagnetic jarring tool may also include a second conductive coil operable to receive a current and generate a second electromagnetic field across at least a portion of the chamber. In such an embodiment, an electromagnetic force generated by the second electromagnetic field may opposes an electromagnetic force of the first electromagnetic field, and the magnetic hammer may be operable to move toward the first end of the chamber in response to the second electromagnetic field to deliver an impact. Such a configuration results in an electromagnetic jarring tool that is operable to deliver an impact in either direction along a tool string.

In another embodiment, the a jarring tool may be constructed approximately as described above, but including a chamber that provides a range of travel for a magnetic hammer that is perpendicular to axis of the tool string. Such a configuration may provide for horizontal jarring forces that typical jar configurations are unable to provide.

Further, in accordance with any of the embodiments described above, the electromagnetic jarring tool may be configured to be self-centering by including a default state for the magnetic fields generated by the first conductive coil or the first conductive coil and second conductive coil to motivate the magnetic hammer toward the center of the chamber.

The electromagnetic jarring tools may be included in a jarring system that also includes a power source and a controller electrically coupled to the power source and the conductive coil (or coils) of the electromagnetic jarring tool. The controller may be a surface controller that is part of a control system that actuates the jarring tool, and may be coupled to the power source to provide current to the conductive coils from the power source. In another embodiment, the surface controller may be coupled to an onboard controller via a control line. The onboard controller may be included in the electromagnetic jarring tool with a local power source that is included within the tool or tool string such that the surface controller may cause the onboard controller to actuate the jarring tool by controlling the flow of current to the conductive coils from the local power source.

An operator at the surface controller may specify a mode of operation that specifies the frequency of jarring impacts, the direction of jarring impacts, and the magnitude of jarring impacts. Based on the specified mode of operation, the surface controller may cause current to flow to the conductive coils that causes the magnetic hammer to move within the chamber to generate the specified impacts. In another embodiment, the surface controller may generate and transmit a control signal to an onboard controller that controls the flow of current to the conductive coils and cause the magnetic hammer to generate impacts that are consistent with the specified mode of operation.

As described above, the application of current to the conductive coils generates a magnetic field to motivate the magnetic hammer the first end of a chamber of the tool and the second end of the chamber to provide jarring forces of the desired magnitude in either direction along the axis of travel of the magnetic hammer. In an embodiment, the jarring forces may be applied in each direction along the axis of a generally cylindrical tool string. Such a tool string may be deployed by any suitable conveyance, which may be a slick line, a wireline, a drill string, or any other suitable tool string.

According to another illustrative embodiment, a method for operating an electromagnetic jarring tool includes applying a current to conductive coils of the electromagnetic jarring tool to activate an electromagnetic field and apply an electromagnetic force to a magnetic hammer included within the tool. The electromagnetic force causes the magnetic hammer to deliver one or more impacts to the first end of the chamber, one or more impacts to the second end of the chamber, or one or more impacts to both ends of the chamber. In an embodiment, the method includes delivering a control signal from a surface controller to a power source to cause current to flow through conductive coils in the electromagnetic jarring tool. The method may also include reversing the direction of current flow through the conductive coils to reverse the direction of the electromagnetic field and electromagnetic force such that the reversed electromagnetic force causes the magnetic hammer to move in the opposite direction.

The method may also include applying a current to a second conductive coil to activate a second electromagnetic field and a second electromagnetic force that oppose the electromagnetic field and electromagnetic force. In accordance with such an embodiment, the controller may be operable to apply a current to the second conductive coil, such that the the second electromagnetic force will cause the magnetic hammer to deliver a second one or more impacts to the second end of the chamber. Such a method may also include simultaneously applying current to the first conductive coil and second conductive coil to center the magnetic hammer in the chamber.

In an embodiment, the method includes delivering a control signal from an onboard controller to a power source to cause the power source to apply current to the conductive coil or second conductive coil. The method may include using the surface controller to transmit a control signal to the onboard controller via a control line or using a wireless communication protocol, such as mud-pulse telemetry or a similar communications protocol.

The method may also include delivering an impact to the first end of the chamber by applying an impact to a tool string.

The illustrative systems, methods, and devices described herein may also be described by the following examples:

Example 1. An electromagnetic jarring tool comprising:
- a chamber having a first end and a second end;
- a magnetic hammer disposed within the chamber; and
- an electromagnet operable to generate an electromagnetic field across at least a portion of the chamber;
- wherein the magnetic hammer is operable to move toward the second end of the chamber in response to the electromagnetic field to deliver an impact.

Example 2. The electromagnetic jarring tool of Example 1, wherein the electromagnet comprises a conductive coil surrounding at least a portion of the chamber.

Example 3. The electromagnetic jarring tool of Example 1, further comprising:
- a second electromagnet operable to receive a current and generate a second electromagnetic field across at least a portion of the chamber;
- wherein an electromagnetic force of the second electromagnetic field opposes an electromagnetic force of the first electromagnetic field; and
- wherein the magnetic hammer is operable to move toward the first end of the chamber in response to the second electromagnetic field to deliver an impact.

Example 4. The electromagnetic jarring tool of Example 3, wherein the second electromagnet comprises a second conductive coil surrounding at least a portion of the chamber.

Example 5. The electromagnetic jarring tool of Example 1, further comprising:
- a second electromagnet operable to receive a current and generate a second electromagnetic field across at least a portion of the chamber;
- wherein an electromagnetic force of the second electromagnetic field opposes an electromagnetic force of the first electromagnetic field; and
- wherein the magnetic hammer is operable to move toward the center of the chamber in response to simultaneous activation of the electromagnetic field and the second electromagnetic field.

Example 6. The electromagnetic jarring tool of Example 5, wherein the second electromagnet comprises a second conductive coil surrounding at least a portion of the chamber.

Example 7. The electromagnetic jarring tool of Example 1, wherein the magnetic hammer comprises a permanent magnet.

Example 8. The electromagnetic jarring tool of Example 1, wherein the magnetic hammer comprises a permanent magnet and a ferromagnetic material.

Example 9. The electromagnetic jarring tool of Example 1, wherein the magnetic hammer includes a projection and wherein the chamber comprises a groove that complements the projection.

Example 10. The electromagnetic jarring tool of Example 1, further comprising a low-friction interface between an outer surface of the magnetic hammer and an inner surface of the chamber.

Example 11. An electromagnetic jarring system comprising:

an electromagnetic jarring tool having a chamber, a magnetic hammer disposed within the chamber and operable to move between a first end and a second end of the chamber, and an electromagnet operable to generate an electromagnetic field across at least a portion of the chamber;

a power source; and a controller electrically coupled to the power source and the electromagnet.

Example 12. The electromagnetic jarring system of Example 11, wherein the electromagnet comprises a conductive coil that surrounds at least a portion of the chamber.

Example 13. The electromagnetic jarring system of Example 11, wherein the controller is a surface controller.

Example 14. The electromagnetic jarring system of Example 11, wherein the controller is operable to apply a current to the electromagnet to motivate the hammer between the first end of the chamber and the second end of the chamber.

Example 15. The electromagnetic jarring system of Example 11, further comprising a second electromagnet coupled to the controller, wherein the controller is operable to apply a current to the second electromagnet to motivate the hammer between the first end of the chamber and the second end of the chamber.

Example 16. The electromagnetic jarring system of Example 15, wherein the second electromagnet comprises a second conductive coil that surrounds at least a second portion of the chamber.

Example 17. The electromagnetic jarring system of Example 11, further comprising a third electromagnet positioned at or near a pre-actuated position of the magnetic hammer.

Example 18. The electromagnetic jarring system of Example 11, wherein the controller is an onboard controller and the power source is an onboard power source, and wherein the controller is coupled to a control line.

Example 19. The electromagnetic jarring system of Example 18, wherein the electromagnetic jarring tool is coupled to a conveyance selected from the group consisting of: a slick line, a wireline, and a drill string.

Example 20. The electromagnetic jarring system of Example 19, wherein the onboard controller is operable to receive a control signal from the conveyance, the control signal specifying a mode of operation.

Example 21. A method for operating an electromagnetic jarring tool having a chamber, a magnetic hammer disposed within the chamber and operable to move between a first end and a second end of the chamber, and an electromagnet operable to generate an electromagnetic field across at least a portion of the chamber, the method comprising:

using the electromagnet to apply an electromagnetic force to the magnetic hammer, the electromagnetic force causing the magnetic hammer to deliver an impact to the first end of the chamber.

Example 22. The method of Example 21, wherein using the electromagnet to apply the electromagnetic force comprises delivering a control signal from a surface controller to a power source.

Example 23. The method of Example 22, further comprising reversing the direction of current provided to the electromagnet to reverse the direction of the electromagnetic field and electromagnetic force, the reversed electromagnetic force causing the magnetic hammer to deliver a second impact to the second end of the chamber.

Example 24. The method of Example 21, further comprising using a second electromagnet to generate a second electromagnetic force that opposes the electromagnetic force to cause the magnetic hammer to deliver a second impact to the second end of the chamber.

Example 25. The method of Example 24, further comprising simultaneously applying the current and second current to center the magnetic hammer in the chamber.

Example 26. The method of Example 21, wherein using the electromagnet to apply an electromagnetic force comprises providing a current to a conductive coil that surrounds at least a portion of the chamber to form the electromagnet.

Example 27. The method of Example 26, wherein using the electromagnet to apply an electromagnetic force comprises delivering a control signal from an onboard controller to a power source.

Example 28. The method of Example 21, wherein applying the current to the conductive coil comprises transmitting a control signal from a surface controller to the onboard controller via a control line.

Example 29. The method of Example 21, wherein causing the magnetic hammer to deliver the impact to the first end of the chamber comprises applying an impact to a tool string.

It should be apparent from the foregoing that an invention having significant advantages has been provided. While the invention is shown in only a few of its forms, it is not limited to only these embodiments but is susceptible to various changes and modifications without departing from the spirit thereof.

The invention claimed is:

1. An electromagnetic jarring tool comprising:

a sealed chamber having a first end and a second end, the sealed chamber being a vacuum chamber or being prefilled with a gas;

a magnetic hammer disposed within the chamber; and an electromagnet that generates an electromagnetic field across at least a portion of the chamber;

wherein the magnetic hammer moves toward the second end of the chamber in response to the electromagnetic field to deliver an impact.

2. The electromagnetic jarring tool of claim 1, wherein the electromagnet comprises a conductive coil surrounding at least a portion of the chamber.

3. The electromagnetic jarring tool of claim 1, further comprising:

a second electromagnet to receive a current and generate a second electromagnetic field across at least a portion of the chamber;

wherein an electromagnetic force of the second electromagnetic field opposes an electromagnetic force of the first electromagnetic field; and wherein the magnetic hammer moves toward the first end of the chamber in response to the second electromagnetic field to deliver an impact.

4. The electromagnetic jarring tool of claim 1, further comprising:

a second electromagnet to receive a current and generate a second electromagnetic field across at least a portion of the chamber;

wherein an electromagnetic force of the second electromagnetic field opposes an electromagnetic force of the first electromagnetic field; and wherein the magnetic hammer moves toward the center of the chamber in response to simultaneous activation of the electromagnetic field and the second electromagnetic field.

5. The electromagnetic jarring tool of claim 1, further comprising a low-friction interface between an outer surface of the magnetic hammer and an inner surface of the chamber.

6. An electromagnetic jarring system comprising:

an electromagnetic jarring tool comprising:

a sealed chamber having a first end and a second end, the sealed chamber being a vacuum chamber or being prefilled with a gas, a magnetic hammer disposed within the chamber and movable between the first end and the second end of the chamber, and an electromagnet to generate an electromagnetic field across at least a portion of the chamber;

a power source; and a controller electrically coupled to the power source and the electromagnet.

7. The electromagnetic jarring system of claim 6, wherein the electromagnet comprises a conductive coil that surrounds at least a portion of the chamber.

8. The electromagnetic jarring system of claim 6, wherein the controller applies a current to the electromagnet to motivate the hammer between the first end of the chamber and the second end of the chamber.

9. The electromagnetic jarring system of claim 6, further comprising a second electromagnet coupled to the controller, wherein the controller applies a current to the second electromagnet to motivate the hammer between the first end of the chamber and the second end of the chamber.

10. The electromagnetic jarring system of claim 9, wherein the second electromagnet comprises a second conductive coil that surrounds at least a second portion of the chamber.

11. The electromagnetic jarring system of claim 6, further comprising a third electromagnet positioned at or near a pre-actuated position of the magnetic hammer.

12. The electromagnetic jarring system of claim 6, wherein the controller is an onboard controller and the power source is an onboard power source, and wherein the controller is coupled to a control line.

13. The electromagnetic jarring system of claim 12, wherein the electromagnetic jarring tool is coupled to a conveyance selected from the group consisting of: a slick line, a wireline, and a drill string.

14. A method for operating an electromagnetic jarring tool having a sealed chamber having a first end and a second end, the sealed chamber being a vacuum chamber or being prefilled with a gas, a magnetic hammer disposed within the chamber and movable between the first end and the second end of the chamber, and an electromagnet that generates an electromagnetic field across at least a portion of the chamber, the method comprising:

using the electromagnet to apply an electromagnetic force to the magnetic hammer, the electromagnetic force causing the magnetic hammer to deliver an impact to the first end of the chamber.

15. The method of claim 14, wherein using the electromagnet to apply the electromagnetic force comprises delivering a control signal from a surface controller to a power source, and further comprising reversing the direction of current provided to the electromagnet to reverse the direction of the electromagnetic field and electromagnetic force, the reversed electromagnetic force causing the magnetic hammer to deliver a second impact to the second end of the chamber.

16. The method of claim 14, further comprising using a second electromagnet to generate a second electromagnetic force that opposes the electromagnetic force to cause the magnetic hammer to deliver a second impact to the second end of the chamber.

17. The method of claim 16, further comprising simultaneously applying the current and second current to center the magnetic hammer in the chamber.

18. The method of claim 14, wherein using the electromagnet to apply an electromagnetic force comprises providing a current to a conductive coil that surrounds at least a portion of the chamber to form the electromagnet.

19. The method of claim 18, wherein using the electromagnet to apply an electromagnetic force comprises delivering a control signal from an onboard controller to a power source.

* * * * *